US008667756B1

(12) United States Patent
Sareyka et al.

(10) Patent No.: US 8,667,756 B1
(45) Date of Patent: Mar. 11, 2014

(54) NOISE DAMPER

(71) Applicants: Brett W. Sareyka, Glen Mills, PA (US); Joshua L. Neal, Elverson, PA (US)

(72) Inventors: Brett W. Sareyka, Glen Mills, PA (US); Joshua L. Neal, Elverson, PA (US)

(73) Assignee: Worthington Armstrong Venture, Malvern, PA (US)

( * ) Notice: Subject to any disclaimer, the term of this patent is extended or adjusted under 35 U.S.C. 154(b) by 0 days.

(21) Appl. No.: 13/694,944

(22) Filed: Jan. 23, 2013

(51) Int. Cl.
*E04B 2/00* (2006.01)

(52) U.S. Cl.
USPC ..... 52/506.06; 52/506.07

(58) Field of Classification Search
USPC ..... 52/506.06, 506.07, 506.08, 512; 248/317, 327
See application file for complete search history.

(56) References Cited

U.S. PATENT DOCUMENTS

| | | | | | |
|---|---|---|---|---|---|
| 2,841,255 | A | | 7/1958 | Kemp | |
| 3,004,644 | A | * | 10/1961 | Hull | 52/506.07 |
| 3,181,274 | A | * | 5/1965 | Izenour | 52/29 |
| 3,214,127 | A | * | 10/1965 | Skidmore et al. | 248/327 |
| 3,599,921 | A | * | 8/1971 | Cumber | 248/317 |
| 3,859,770 | A | * | 1/1975 | Chambers et al. | 52/745.05 |
| 4,624,088 | A | * | 11/1986 | Arent | 52/506.07 |
| 5,397,090 | A | * | 3/1995 | Carson et al. | 248/327 |
| 5,664,754 | A | * | 9/1997 | Gaenslen | 248/317 |
| 7,025,317 | B2 | * | 4/2006 | Masas | 248/317 |
| 7,028,432 | B2 | | 4/2006 | Manos et al. | |
| 7,743,572 | B2 | | 6/2010 | Ducharme | |

FOREIGN PATENT DOCUMENTS

| | | | |
|---|---|---|---|
| EP | 0037517 | A1 | 10/1981 |
| EP | 0433815 | A1 | 6/1991 |
| EP | 1188875 | A1 | 3/2002 |
| JP | 2000038800 | A | 2/2000 |
| JP | 2000087497 | A | 3/2000 |

OTHER PUBLICATIONS

Web page printed out Dec. 6, 2010 from "Silent Source" website (http://www.silentsource.com), Northhampton, MA re: subject of Isolation Hangers.

* cited by examiner

*Primary Examiner* — Basil Katcheves
(74) *Attorney, Agent, or Firm* — Eugene Chovanes

(57) ABSTRACT

Noise dampers of sound absorbent material are inserted on the metal grid beams in a suspended ceiling.
Hangers, embedded in a structural ceiling, that support the beams, are insulated from the beams by the noise dampers. Sound vibrations generated in the structural ceiling, which is often a floor, are not transmitted through the hangers, to the suspended ceiling, or to the room, below, but are absorbed in the dampers before reaching the grid beams.

2 Claims, 6 Drawing Sheets

FIG.11
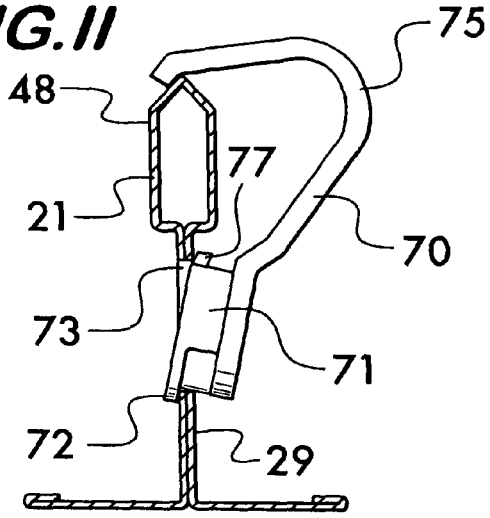
FIG.12
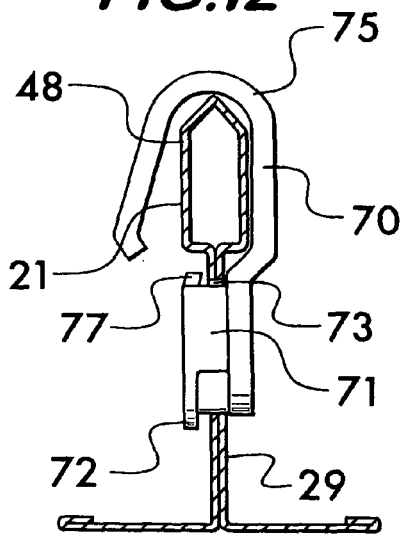
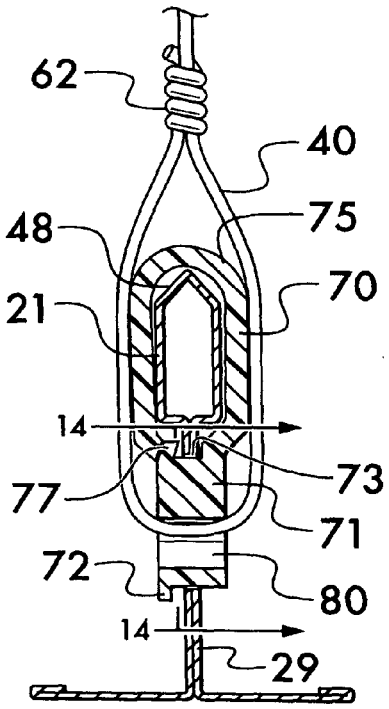
FIG.13
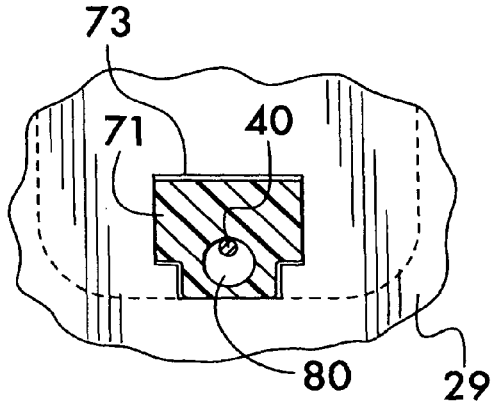
FIG.14

NOISE DAMPER

CROSS-REFERENCES TO RELATED APPLICATIONS

This application is a continuation-in-part of co-pending U.S. application Ser. No. 13/136,983, filed Aug. 16, 2011.

BACKGROUND OF THE INVENTION

1. Field of the Invention

The invention relates to noise control in suspended ceilings. Such suspended ceilings have a grid of intersecting metal beams that are suspended by hangers from a structural ceiling. Panels or drywall sheets are supported on the grid.

Noise generated in the structural ceiling, which is frequently a floor for the space above, is transmitted by sound vibrations passing downward through the hangers, which form a sound path, to the grid of the suspended ceiling. The suspended ceiling, which includes panels or drywall sheets attached to the beams in the grid, forms a receiver for the sound vibrations, which broadcasts the resulting unwanted noise to the space below.

The invention deals with deadening such sound vibrations coming down the hangers.

2. Prior Art

Suspended ceilings are constructed in a special way so that the ceilings are extremely stable. Over many years, a standard way of constructing such ceilings has evolved. Suspended ceilings are constructed at a building site by individually embedding an anchor, such as an eye bolt, into the structural ceiling, and then attaching a hanger, such as a wire, to the anchor, by twisting the wire about the anchor. The anchor is secured explosively, or by any other means, such as bolting into the structural ceiling. The lower end of the hanger is attached to a metal beam in a grid that supports panels, or drywall sheets, by looping the hanger through a hole in the web of the beam and twisting the loop closed around the bulb and a segment of the beam.

The substantial weight of the suspended ceiling is spread among numerous hangers that are spaced every few feet along the main beams in the grid. Each hanger must be individually secured to the structural ceiling, and to the grid beam, by an installer who must keep the grid of interconnected main and cross beams level at a desired height. Much time and effort is required to hang a suspended ceiling grid from a structural ceiling.

Much more time and effort is required where sound attenuator devices that dampen the vibrations coming down a hanger sound path, from noise generated in a structural ceiling, are used.

In the prior art, to control noise in a suspended ceiling, a noise attenuator is individually inserted by the installer, about midway in the length of a wire hanger that is cut into two segments. An upper segment of the wire hanger is first secured at its top to the structural ceiling, and at its bottom, to a top terminal in the attenuator. A lower segment of the wire hanger is connected at the top to a bottom terminal in the attenuator, and then, at the bottom of the lower segment, to the grid beam.

In such prior art attenuator, the upper and lower metal terminals are separated from each other by a suitable amount of sound vibration damping material, such as gum rubber. Sound vibrations coming down the wire hanger sound path from the structural ceiling, which frequently serves as a floor for the building level above, are absorbed in the noise attenuator.

The insertion of such prior art noise attenuators in a wire hanger that must be divided into two segments is time and labor consuming, since the normally single segment of a wire hanger must not only be divided into two segments, but each segment must then be secured to the noise attenuator by passing the hanger through an attenuator terminal, and then twisting the hanger back around the segment. Thus, instead of just two attachments of a single segment of a wire hanger at an upper end to the structural ceiling, and at its lower end to a grid beam itself, as in prior art suspended ceilings with no noise attenuation, there are two additional attachments involving threading the wire hanger through a hole, and then twisting the wire hanger back upon itself, to the noise attenuator.

Such manual cutting, threading, and twisting must be individually custom performed by the installer of the grid in the field during the construction of the ceiling, since good judgment must be exerted at each wire hanger to keep the grid level, through controlling the length of the wire hanger suspensions.

BRIEF SUMMARY OF THE INVENTION

A noise damper, of material that deadens sound vibrations coming down a hanger, is inserted between the grid beam and a hanger in the construction of the suspended ceiling.

The noise damper insulates the entire hanger attached to the structural ceiling from contact with the metal grid beam in the suspended ceiling, so the sound vibrations passing down the hanger are deadened in the noise damper. The noise damper, however, does not interfere with the structural support of the grid beam and suspended ceiling by the hangers, which are generally of wire, but permissibly of other material having adequate tensile strength to support the suspended ceiling.

The time required to install a suspended ceiling with the present invention is virtually the same as the time required to install a prior art suspended ceiling without any noise damping. In the present invention, the noise damper, which is of a resilient, sound vibration deadening material, can be merely inserted into place, and the hanger attached to the beam by looping a wire hanger through a knock-out in the beam, as done in the prior art in a suspended ceiling that is not sound dampened.

The knock-out can be shaped so the stress that the suspended ceiling imparts to the hanger where it passes through the knock-out is distributed over a section of the noise damper, rather than concentrated at the site of the hanger.

BRIEF DESCRIPTION OF SEVERAL VIEWS OF THE DRAWING

(b) a prior art ceiling segment with noise damping; and (c) a suspended ceiling with the noise damper of the invention

FIG. 11 is an elevational view of the noise damper shown in FIG. 6 in its initial contact with the beam, when being inserted into the beam.

FIG. 12 is an elevational sectional view showing the noise damper of FIG. 6 inserted into a beam, with the top of the damper hooked over the bulb of the beam.

FIG. 13 is a sectional elevational view of the noise damper shown in FIG. 6 inserted into the beam, with a hanger looped through the damper.

FIG. 14 is a view taken on the line 14-14 of FIG. 13.

DETAILED DESCRIPTION OF THE INVENTION

Although the invention is illustrated with hangers of wires, which is the predominant material used to suspend present day ceilings, the invention can be used with other forms of hangers, such as rods, or chains.

Figure 2:
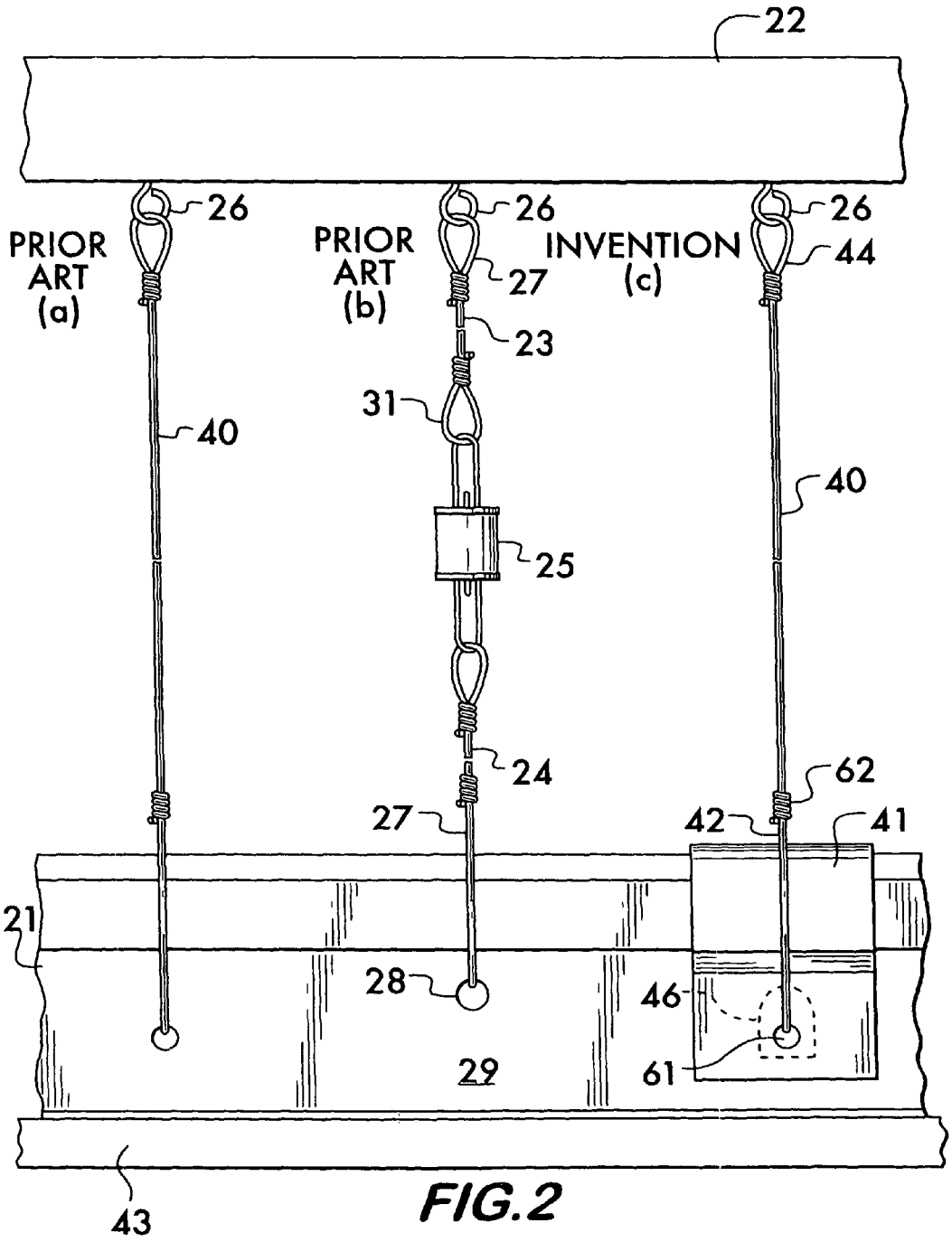
FIG. 2 is an elevational view comparing (a) a prior art suspended ceiling segment without noise damping.
Figure 6:
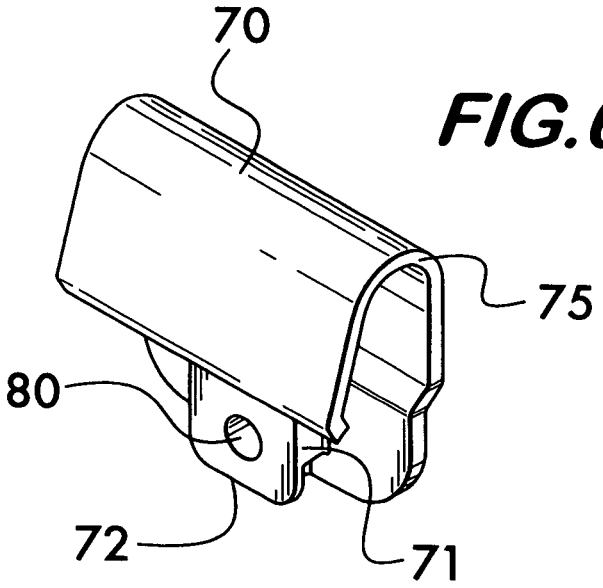
FIG. 6 is a perspective view of another embodiment of the invention.
Figure 8:
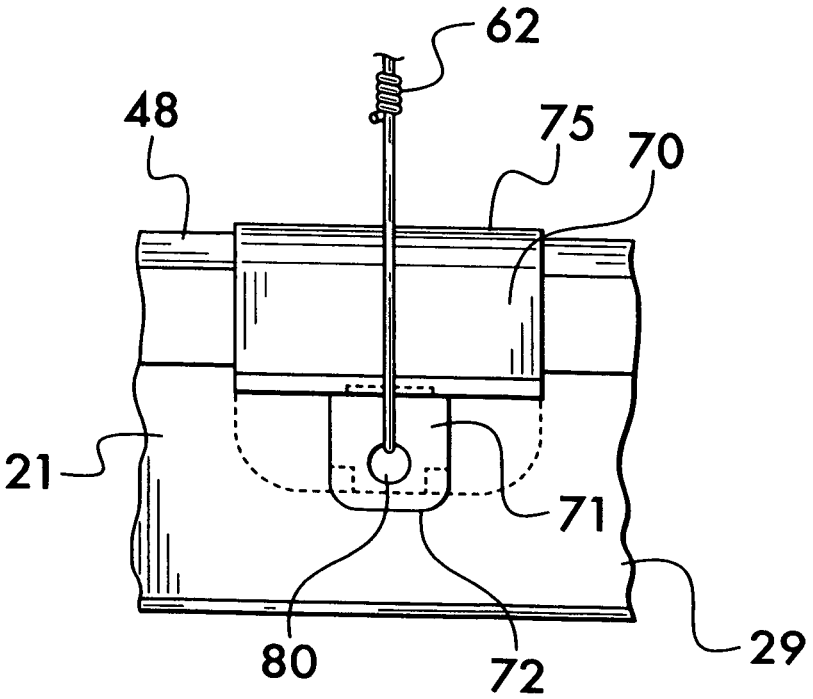
FIG. 8 is a side view of the noise damper of FIG. 6 inserted into a beam.
Figure 7:
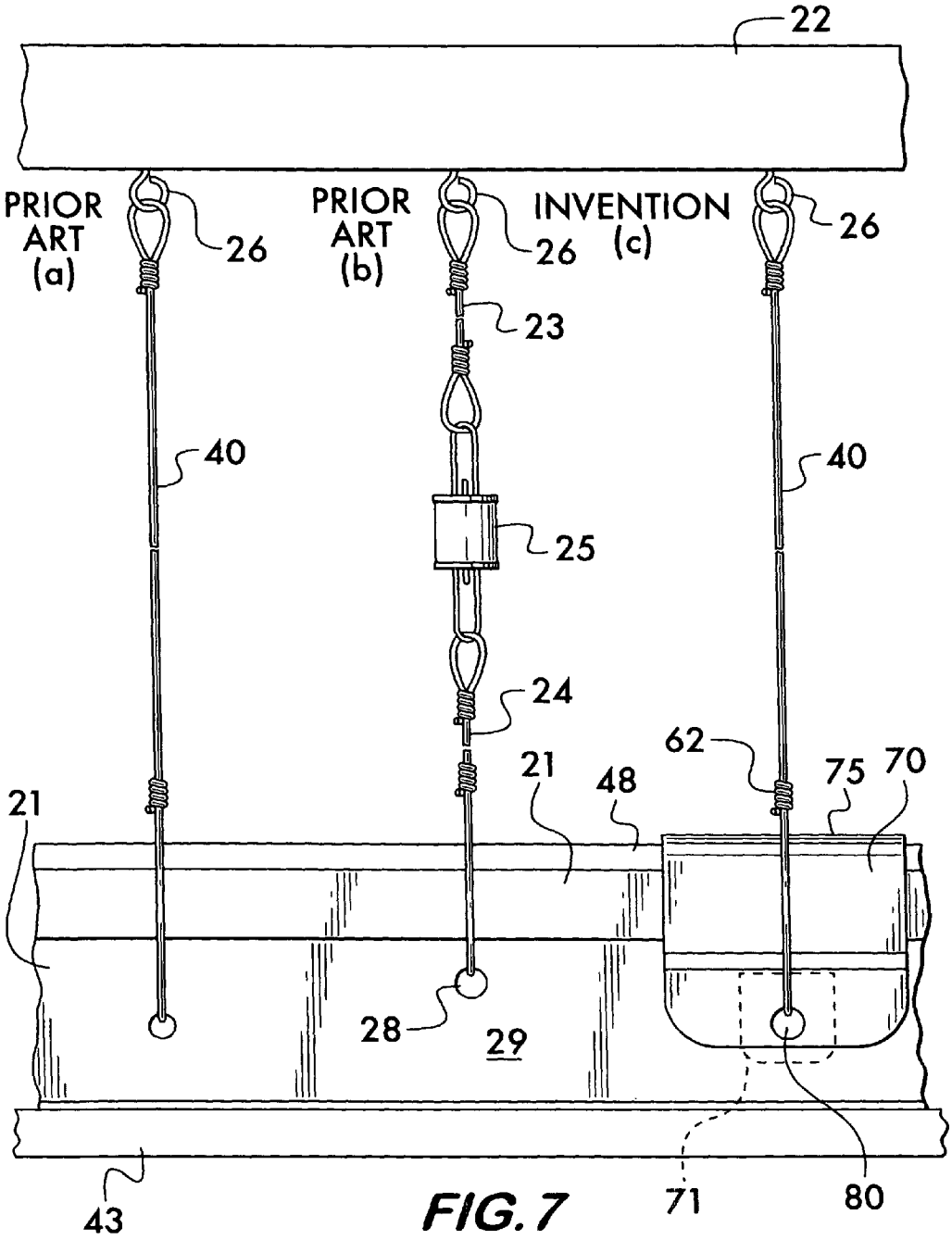
FIG. 7 is a suspended ceiling with the embodiment of the invention shown in FIG. 6, along with related prior art.

In FIG. 2, there is shown comparatively (a) a prior art ceiling without noise damping; (b) a prior art ceiling with noise damping; and (c) the noise dampened suspended ceiling of the present invention. In a prior art suspended ceiling installation without noise damping, (FIG. 2*a*), the suspended ceiling 43, is hung from a structural ceiling 22, by wire hangers 40 embedded in the structural ceiling at the top, and looped through about the grid beam 21 at the bottom. A single length of wire hanger 40 is used.

In FIG. 2*b*, a wire hanger is cut in two into segments, 23 and 24, and secured to the structural ceiling 22 and suspended ceiling 43 as shown. A grid beam 21 is suspended from structural ceiling 22 by an upper wire segment 23 and a lower wire segment 24, connected to a sound attenuator 25. The upper wire segment 23 is looped through an eye bolt 26 explosively embedded in the structural ceiling 22, and manually twisted to close the loop 27. Similar connections are made to sound attenuator 25 at the bottom of segment 23 and at the top of the lower segment 24. At the bottom of the lower segment 24, there is formed a loop 27 that passes through a hole 28 in the web 29 of grid beam 21. The loop 27 is closed by twisting the wire hanger segment 24.

In the present invention, as shown in FIG. 2*c*, a single length of wire hanger 40 is used to suspend a beam 21 at suspension points along the beam 21. A noise damper is inserted onto grid beam 21 between the suspension loop 42 at the bottom of wire hanger 40 and the grid beam 21, to insulate the beam 21 from the wire hanger 40. The noise damper 41 of the invention deadens the sound vibrations from structural ceiling 22 as they travel down the wire hanger 40, before the vibrations reach the metal grid beam 21, in the suspended ceiling 43, which would serve as a receiver that would broadcast the noise to the space below.

At the top, the wire hanger 40 is looped through eye bolt 26 explosively embedded in structural ceiling 22, and the loop 44 is twisted closed. The lower end of wire hanger is passed through hole 61 in noise damper 41 on grid beam 21, and passes through knock-out 46.

Figure 5:
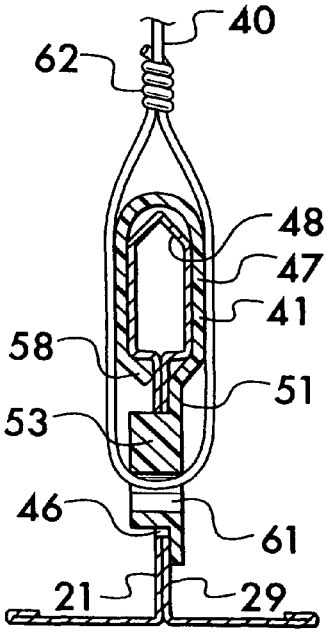
FIG. 5 is an enlarged sectional view taken on the line 5-5 in FIG. 3.
Figure 4:
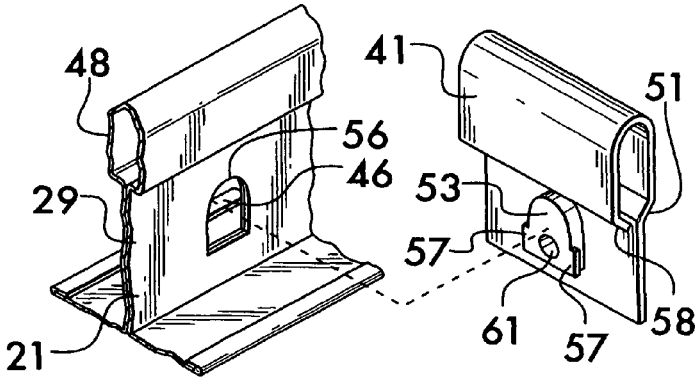
FIG. 4 is an exploded perspective view of a section of a grid beam showing a knock-out that seats a conforming raised section of a noise damper.

Noise damper 41 has an inverted U-shaped upper portion 47 conforming in cross section to the bulb 48 of the grid beam 21, as seen particularly in FIG. 5. A flat lower portion 51 is intended to lie along the web 29 of the grid beam 21 as seen in FIG. 5.

A raised insert 53 on flat lower portion 51 is shaped to conform to a knock-out 46, desirably with the shape of an arch 56 at the top. Lip retainers 57 hold the raised insert 53 firmly in the knock-out 46. An angled lip 58 on the U-shaped clip portion 47 retains such U-shaped portion 47 of the noise damper 41 on the bulb 48 of the grid beam 21. A hole 61 that receives wire hanger 40 extends through the raised insert 53 and knock-out 46.

The noise damper 41 is injection molded into one resilient integral piece from a vibration deadening material. An example of such a material is thermoplastic vulcanizate, an elastomer, that includes carbon black and a paraffin wax. Such material, in pellet form, is injection molded into the form of the noise damper 41 insert of the invention. The noise damper 41, when molded, is flexible, and can readily expand when being inserted onto the grid beam 21, to envelope the grid beam 21 as depicted in the drawings.

Figure 1:
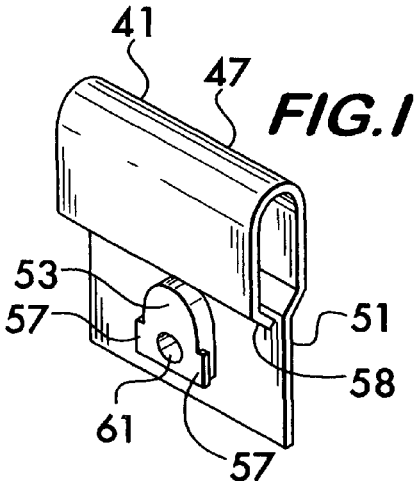
FIG. 1 is a perspective view of the noise damper of the invention.
Figure 3:
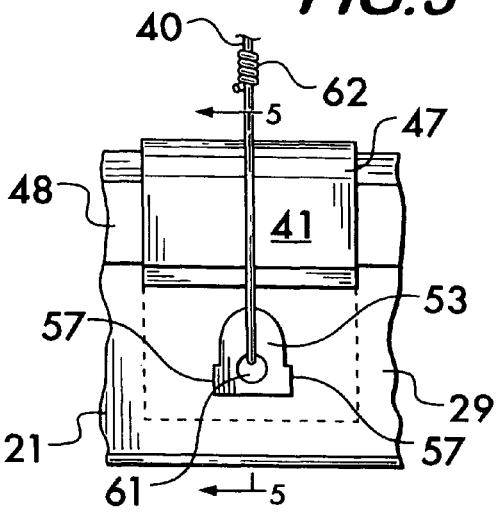
FIG. 3 is a side elevational view of a noise damper in place on a grid beam with a wire hanger looped through the noise damper and beam.

The noise damper 41 is inserted onto the beam by passing the inverted U-shape portion 47 vertically downward over the bulb 48 of grid beam 21 to seat raised insert 53 in knock-out 46. The noise damper 41 expands while being inserted onto the grid beam 21, and contracts to the position about the beam 21, and into knockout 46, as shown particularly in FIGS. 3 and 5.

A single length of wire hanger 40, which has been embedded previously in the structured ceiling, is then looped through the hole 61 in the noise damper 41, as shown in FIG. 5, and then twisted at 62 to close the loop.

In this manner, the metal wire hanger 40 is insulated from metal grid beam 21, while still structurally supporting the grid beam 21.

A series of wire hangers 40 and noise dampers 41 are applied at, for instance, four (4) foot intervals along the main grid beams 21. The knock-outs 46 may be pre-punched at more frequent intervals, along the beam, and the noise dampers 41 inserted selectively. The knock-outs 46 do not appreciatively affect the strength of the grid beams 21.

By means of the present invention, as set forth above, the hanger 40 which acts as a sound path from the structural ceiling 22 noise source to the suspended ceiling 43 which acts as a receiver is interrupted and dampened by the noise damper 41 of the invention.

The noise dampers 41 can be inserted at the job site as the grid beams 21 are being hung, or in the alternative, the noise dampers 41 can be inserted on the grid beams 21 before the grid beams 21 themselves are shipped to the job site.

In case of a fire, even though the noise dampers 41 of the invention are destroyed, wire hangers 40 continue to support the grid beams 21, since the wire hangers 40 remain attached to the grid beams 21.

Figure 9:
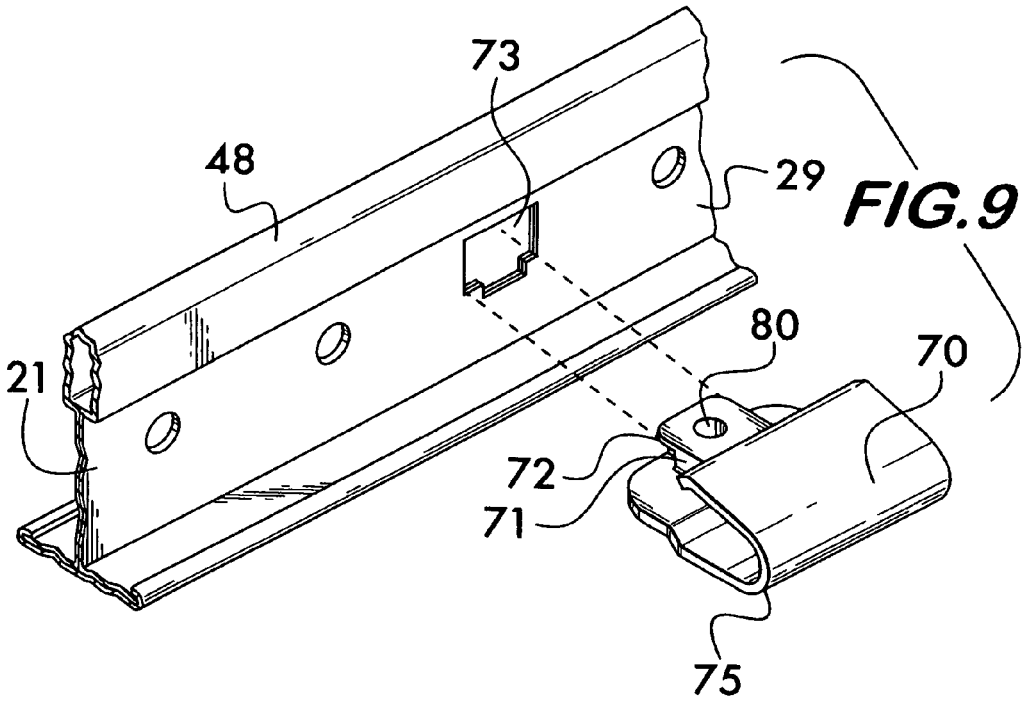
FIG. 9 is a perspective view of the noise damper of FIG. 6 about to be inserted into a beam.
Figure 10:
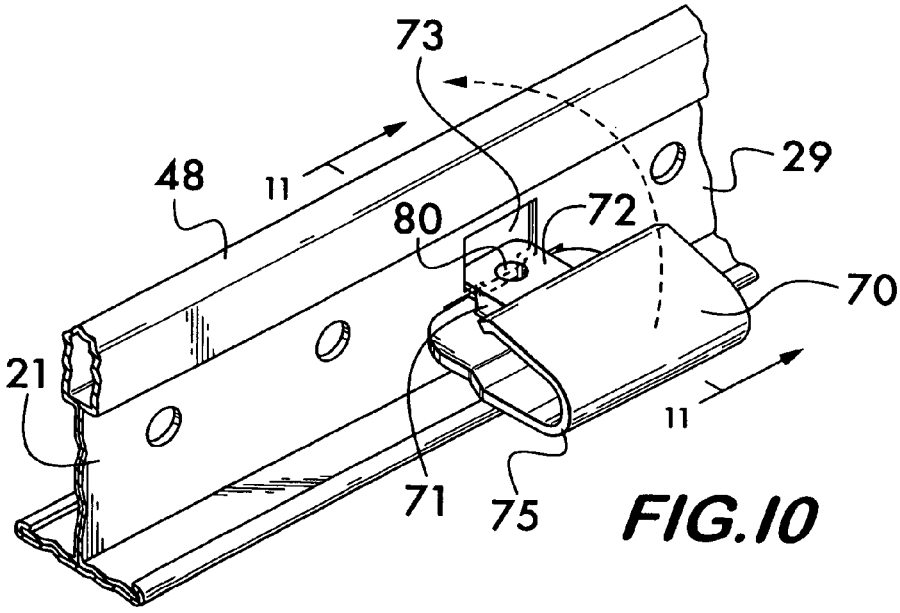
FIG. 10 is a perspective view of the embodiment of the invention shown in FIG. 6, showing the first contact of the noise damper being inserted into a beam.

In FIGS. 6 through 14, there is shown another noise damper embodiment 70 wherein raised insert 71 conforms in shape to knock-out 73 and has at the bottom thereof a lower lip 72 that extends behind the knock-out 73 when the bottom of raised insert 71 is forced through the knock-out 73. This secures the bottom of the raised insert 71 to the web 29 of the grid beam 21, as seen in FIGS. 9, 10, and 11.

The top of the raised insert 71 is then forced through the knock-out 73 into the position shown in FIG. 12, wherein upper lip 77, along with lower lip 72, secures the raised insert 71 in the knock-out 73. As the raised insert 71 is being forced into knock-out 73, as described above, inverted U-shaped upper portion 75 is also being extended over bulb 48 of grid beam 21, as seen in FIG. 11, into the position shown in FIG. 12, wherein the noise damper embodiment 70 is locked into knock-out 73 in web 29 of grid beam 21, and inverted U-shaped upper portion 75 of noise damper embodiment 70 is hooked over bulb 48 of grid beam 21.

Hanger 40 is then looped through hole 80 of noise damper embodiment 70, and twisted closed, as seen in FIG. 13.

As seen in FIGS. 13 and 14, hanger 40 is isolated from grid beam 21 by noise damper embodiment 70, with sound waves coming down the hanger being absorbed into noise damper embodiment 70.

What is claimed is:

1. In a noise damper (70) that absorbs noise vibrations in a structure formed of a. a structural ceiling (22) that is a source of noise vibrations;

b. hangers (40) that form a noise path for the noise vibrations, and that extend downward from the structural ceiling (22); and c. a suspended ceiling (43) that includes grid beams (21), supported by the hangers (40), that is a receiver for the noise vibrations;

the improvement comprising a noise damper (70), made of flexible sound vibration damping material, inserted into a knock-out (73) in a web (29) of the grid beam (21) in the suspended ceiling (43), that insulates the hanger (40) from the grid beam (21) and absorbs the noise vibrations along the hanger (40), the noise damper (70) having a) a raised insert (71) on a lower segment of the damper that conforms in shape to the knock-out (73) in the web (29) of the grid beam (21);

b) a lower lip (72) at the bottom of the raised insert (71) that engages a lower section of the knock-out (73) to secure the bottom of the damper to the grid beam (21);

c) an upper lip (77) at the top of the raised insert (71) that secures the raised insert (71) in the knock-out (73) when the lower lip (72) on the raised insert (71) is engaged with the lower portion of the knock-out (73); and d) an inverted U-shaped upper portion (75) of the noise damper (70) that extends from the raised insert (71) over a bulb (48) of the grid beam (21), along with the lower section of the noise damper 70, including the raised insert (71) on the lower section, that isolates the grid beam 21 from the e) hanger (40) which extends through a hole (80) in the lower section of the damper.

2. A method of inserting the noise damper (70) of claim 1 into the grid beam (21) the method comprising a) inserting the lower lip (72) through the knock-out (73) to secure the bottom of the noise damper (70) in the knock-out (73); and b) securing the upper lip (77) at the top of the raised insert (71) to an upper portion of the knock-out (73), while extending the inverted U-shaped upper portion (75) of the noise damper (70) over the bulb (48) of the grid beam (21).

* * * * *